US005560678A

United States Patent [19]

Eppelt

[11] Patent Number: 5,560,678

[45] Date of Patent: Oct. 1, 1996

[54] DEVICE FOR JOINING TOGETHER CHAIRS IN A ROW

[75] Inventor: Thomas Eppelt, Pfaffenhofen, Germany

[73] Assignee: Casala-KI Möbelwerke GmbH, Lauenau, Germany

[21] Appl. No.: 407,374

[22] Filed: Mar. 20, 1995

[30] Foreign Application Priority Data

Apr. 23, 1994 [DE] Germany ..... 94 06 826.7

[51] Int. Cl.[6] ..... A47C 1/124

[52] U.S. Cl. ..... 297/248

[58] Field of Search ..... 297/232, 248

[56] References Cited

U.S. PATENT DOCUMENTS 4,884,842 12/1989 Finkelstein ..... 297/344.18 X
5,129,703 7/1992 Ballendat et al. ..... 297/248

FOREIGN PATENT DOCUMENTS 1985083 5/1968 Germany .
2218289 10/1973 Germany ..... 297/248
2402525 7/1975 Germany .
99658 11/1961 Netherlands ..... 297/232

*Primary Examiner*—Peter R. Brown
*Attorney, Agent, or Firm*—Shlesinger, Arkwright & Garvey

[57] ABSTRACT

The device for joining chairs in a row is dimensionally stable, easily operated, and, hence, panic-proof. In one preferred embodiment of the invention the device includes a first component configured for being mounted to a chair; a first borehole defined in the first component; a first locking pin disposed in the first component and extending into the first borehole; a second component configured for being mounted to a chair; a second borehole defined in the second component; a second locking pin disposed in the second component and extending into the second borehole; and a connection element displaceably mounted in the first borehole, the connection element being configured for insertion into the second borehole, and a first locking element disposed on the connection element for engaging the first locking pin for preventing displacement of the connection element.

14 Claims, 3 Drawing Sheets

DEVICE FOR JOINING TOGETHER CHAIRS IN A ROW

FIELD 0F THE INVENTION

The invention relates to a device for joining chairs together in a row.

BACKGROUND OF THE INVENTION

Such devices for joining chairs together are known in the most diverse designs.

Illustratively the German Gebrauchsmuster 1,985,083 discloses means for chair attachment in rows that comprises two fittings affixed to the underside of chairs. The affixing fittings comprise two affixing brackets. The affixing bracket of one of the fittings includes outwardly open, U-shaped extensions with boreholes, while the affixing bracket of the other fitting comprises an elastic, U-shaped pivotably supported connection element or bail with outwardly angled ends. The bail is insertable into the fitting boreholes to implement the attaching of the chairs in a row, and the legs of the bail require manual compression. To achieve reliable joining, the bails must be fairly rugged, whereby handling is made more difficult. The attachment in the resulting row is somewhat loose on account of the pivotably resting bails.

OBJECTS AND SUMMARY OF THE INVENTION

The object of the present invention is to create a device for joining chairs in a row in a dimensionally stable, simply operated and panic-proof manner.

This problem is solved by a preferred embodiment of the invention having a first component configured for being mounted to a chair; a first borehole defined in the first component; a first locking pin disposed in the first component and extending into the first borehole; a second component configured for being mounted to a chair; a second borehole defined in the second component; a second locking pin disposed in the second component and extending into the second borehole; and a connection element displaceably mounted in the first borehole, the connection element being configured for insertion into the second borehole, and a first locking element disposed on the connection element for engaging the first locking pin for preventing displacement of the connection element.

Advantageous and appropriate developments of the solution of the invention are described below.

The invention is elucidated below in relation to the attached drawings showing an illustrative embodiment.

BRIEF DESCRIPTION OF THE DRAWINGS

The same reference numerals denote the same components in the Figures of the drawing.

The same reference numerals denote the same components in the Figures of the drawing.

DETAILED DESCRIPTION OF THE INVENTION

Figure 1:
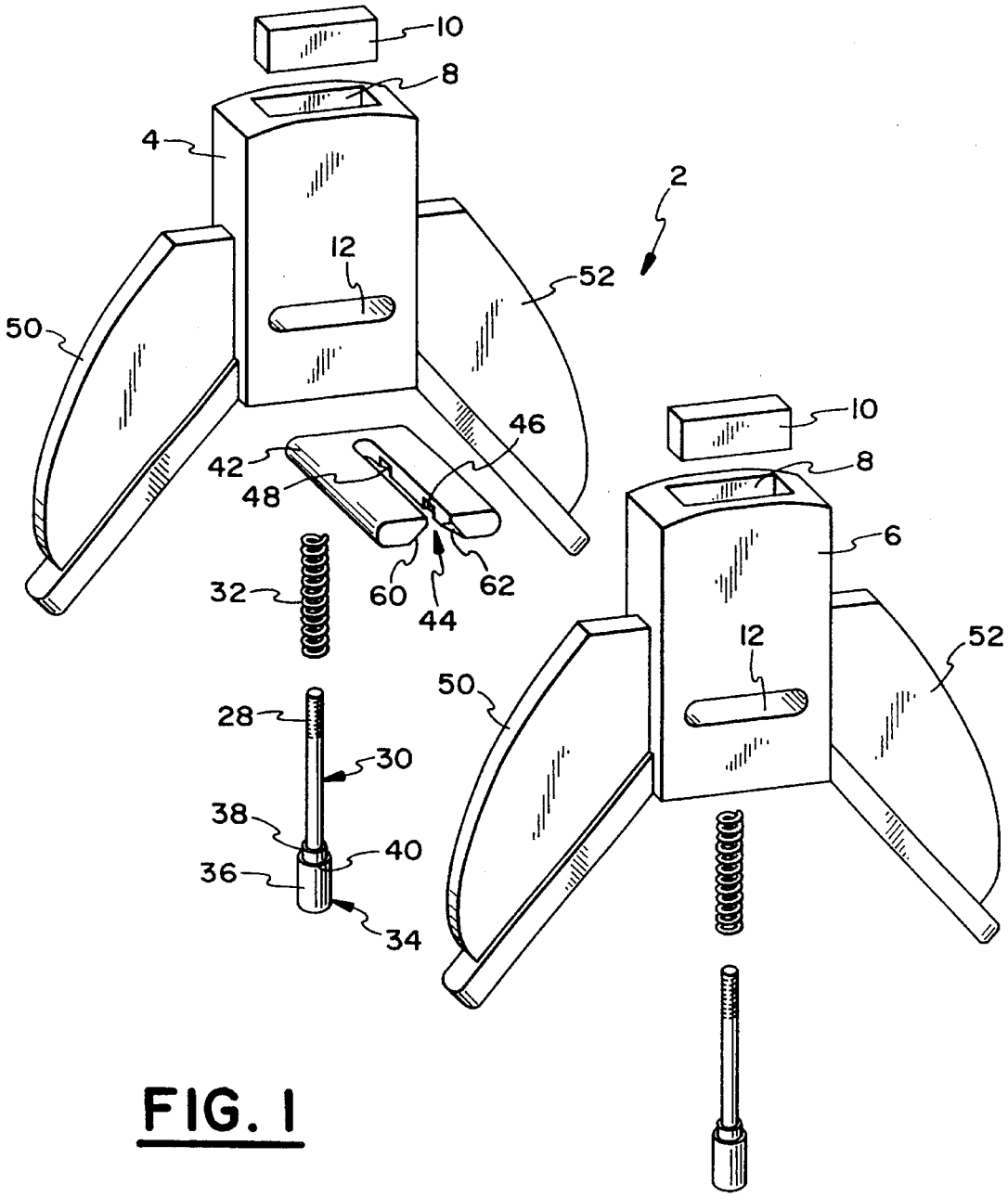
FIG. 1 is an exploded view of a device according to a preferred embodiment of the invention for joining chairs in a row.

FIGS. 1–4 show a preferred embodiment of a device 2 to join chairs in rows and consisting of a first component 4 mounted to one side of the chair and of a second component 6 mounted at the opposite side of the chair. The components 4 and 6 are substantially identical.

Illustratively the components 4 and 6 are composed of a parallelipipedic block. First and second components 4 and 6 each comprises a topside clearance 8 receiving a depressing element 10 and a transverse clearance 12 and a through-borehole 14 starting at the topside clearance 8, then crossing the transverse clearance 12 and issuing into the underside of the components 4 and 6. Between the upper clearance 8 and the transverse clearance 12, the through-borehole 14 includes a stepped borehole 16. Stepped borehole 16 includes a first bolehole segment 18 issuing into the topside clearance 8, the diameter of the first borehole segment 18 being larger than that of a second borehole segment 20 issuing into the clearance 12, whereby an annular shoulder 22 is defined between the two borehole segments 16 and 18.

Between the transverse clearance 12 and the underside of the components 4 and 6, the through-borehole 14 includes a third borehole segment 24 of which the diameter is larger than that of the second borehole segment 20 of the stepped borehole 16 issuing into the clearance 12.

The depressing element 10 is provided at its lower part with a threaded borehole 26 receiving a thread 28 of an affixing or locking pin 30 insertable into the through-borehole 14. A helical spring 32 is inserted into the borehole segment 18 of the stepped borehole 16 and rests against the underside of the depressing element 10 and against the annular shoulder 22. The diameter of the affixing pin 30 corresponds approximately to that of the second borehole segment 20 of the stepped borehole 16.

The affixing pin 30 comprises a stepped head 34 with a terminal first cylindrical part 36 and an adjoining second cylindrical part 38 on the side of the thread. The diameter of second part 38 is less than that of the first cylindrical part 36 but larger than that of the second borehole segment 20 of the stepped borehole 16. A transition zone 40 between the two cylindrical parts 36 and 38 maybe conical if so desired.

The head 34 of the affixing pin 30 is located in the third borehole segment 24 of the through-borehole 14.

A bail or connection element 42, complementary in shape to that of the transverse clearance 12 of either component 4 or 6 of the junction device of the chair 2, is displaceably mounted in clearance 12. Connection element 42 comprises an open-end slot 44 of which the inside wall is fitted with two or more spaced cylindrical recesses 46, 48 to receive in a snap-in manner at least the head portion 38 of head 34 of the affixing pin 30.

In its initial position, the connection element 42 is in the snap-in position wherein the head 34 is biased by the spring 32 into engagement with the outer recess 46. In this snap-in state, the depressing element 10 is in its upper position (FIGS. 2 through 4), and seals the outer end of connection element 42 flush with the outside wall of the component 4 or 6.

Figure 3:
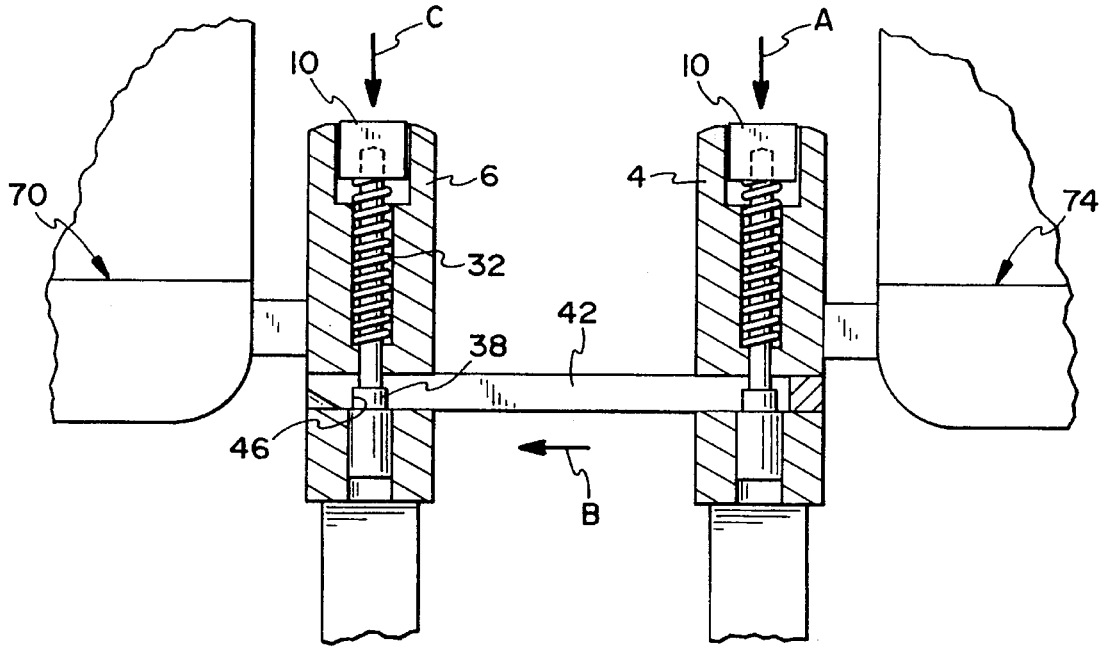
FIG. 3 shows the device of FIG. 1 when engaged and mounted to two chairs.
Figure 4:
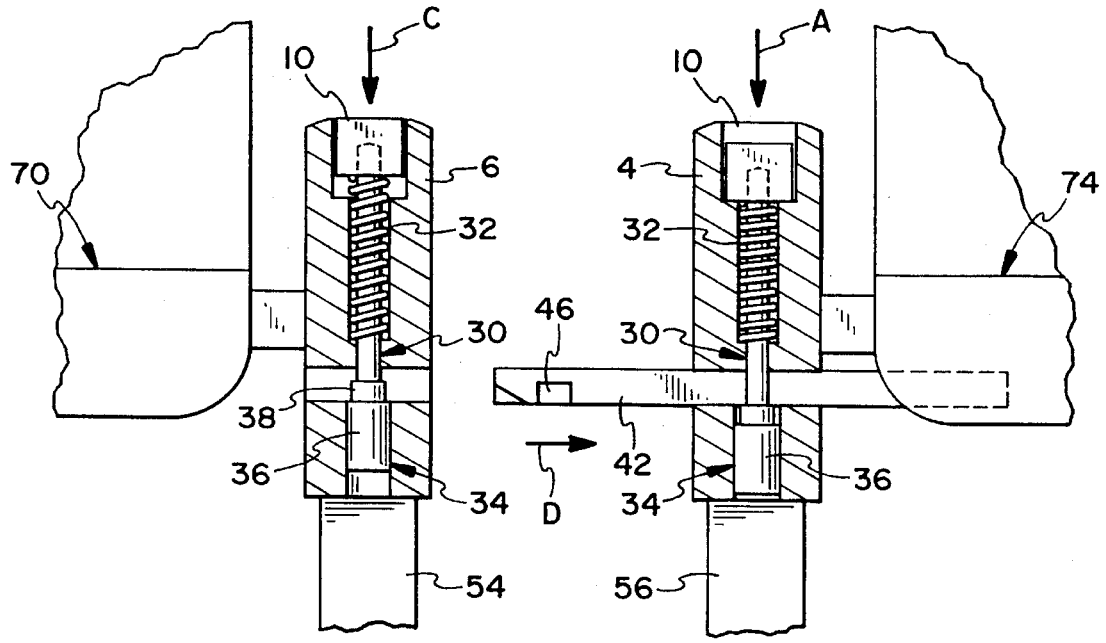
FIG. 4 shows the device of FIG. 1 mounted to two chairs but disengaged.

By depressing in the direction of arrow A the element 10, for instance element 10 on the right in FIGS. 3 and 4, the connection element 42 can be pulled out in the direction of arrow B from the associated component, for instance 4, until it snaps into position at the inner recess 48. Preferably an omitted spring biases the connection element 42 in the direction of arrow B, whereby the depressing element 10 automatically forces connection element 42 out of its initial position to snap into the inner recess 48.

Thereupon the connection element 42 can be inserted into the component 6 of another junction device of a chair to be joined until such connection element 42, by means of its outer recess 46, snaps-in at the affixing pin 30 of the said component 6. At the front end of its slot 44 and at the lower side of both extensions, connection element 42 is fitted with bevels 60, 62 running onto the head step or operational surface of an affixing pin being engaged and thereby automatically depressing affixing pin 30 until its head 34 snaps into the recess 46, as a result of which the depressing element 10 at the component 6 of the chair being joined need not be actuated.

To disengage the row-joined chairs, the depressing element 10 of component 6, namely the left element in FIGS. 3 and 4, of the joined chair, is depressed in the direction of arrow C, whereby the head 34 of the affixing pin 30 moves out of the recess 46. Thereupon the connection element 42 can be withdrawn from the component 6 in the direction of arrow D. By actuating the depressing element 10 (in the direction of arrow A) of the component 4 of the junction device of the other chair, connection element 42 can be returned in the direction of arrow D to its initial position.

Figure 2:
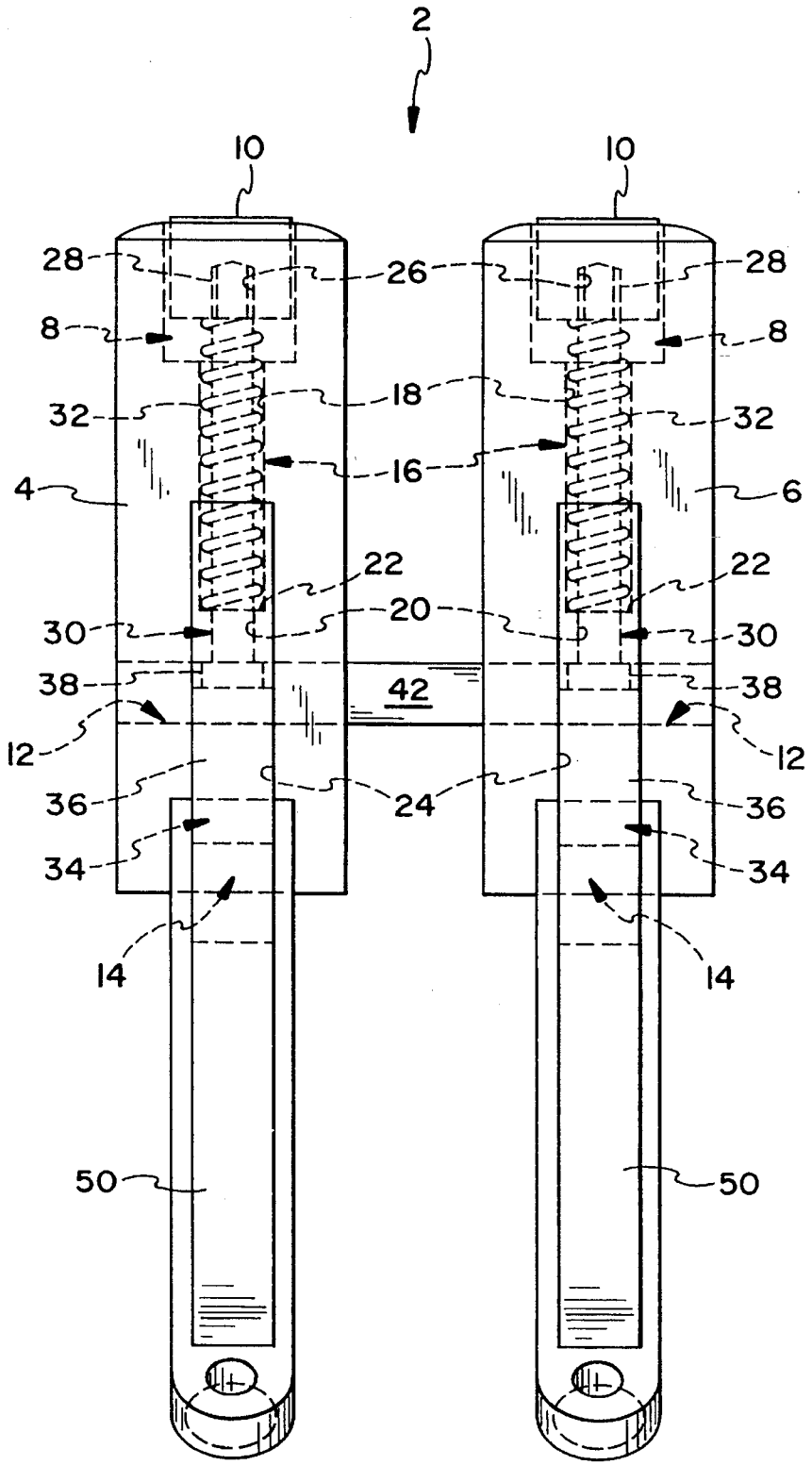
FIG. 2 is a view of the device of FIG. 1 when engaged.

As schematically shown in FIGS. 3 and 4, the components 4 and 6 are designed preferably to be affixed to chair legs 54, 56 of chairs 70, 74, respectively. For that purpose, and as shown in Figs. 1 and 2, they preferably comprise angled sides, or plates, 50, 52 to which the chair legs 54, 56 shall be affixed. Affixing chair legs 54, 56 for instance is implemented in such manner that these legs by means of their matching clearances are slipped onto the respective plates 50, 52 to which they are then connected by screws or bonding means.

The above described device for joining in rows allows not only the serial joining of chairs lacking arm rests, but also the alternating joining of chairs and arm-rest chairs to one another. The device according to the invention is easily operated and thereby it is panic-proof.

I claim:

1. A device for joining chairs in a row, comprising:

a) a first component configured for being mounted to a chair;

b) a first borehole defined in said first component;

c) A first locking pin disposed in said first component and extending into said first borehole;

d) a second component configured for being mounted to a chair;

e) a second borehole defined in said second component;

f) a second locking pin disposed in said second component and extending into said second borehole;

g) a connection element displaceably mounted in said first borehole, said connection element being configured for insertion into said second borehole, and a first locking element provided on said connection element for engaging said first locking pin for preventing displacement of said connection element relative to said first component;

h) a second locking element provided on said connection element for engaging said second locking pin for preventing displacement of said connection element; and i) a pair of extensions having free ends defining an outwardly open slot in said connection element, and said outwardly open slot being configured for receiving said second locking pin.

2. A device for joining chairs in a row as defined in claim 1, wherein:

a) a spring is provided in said first component for biasing said first locking pin into engagement with said connection element.

3. A device for joining chairs in a row as defined in claim 1, wherein:

a) a spring is provided in said second component for biasing said second locking pin into engagement with said connection element.

4. A device for joining chairs in a row as defined in claim 1, wherein:

a) said first locking element includes a recess defined in a slot wall of one of said extensions defining said outwardly open slot.

5. A device for joining chairs in a row as defined in claim 4, wherein:

a) a snap-in element is provided on said first locking pin;

b) a bevel is provided at the free end of one of said extensions defining said outwardly open slot, said bevel is configured for engaging said snap-in element for moving said first locking pin.

6. A device for joining chairs in a row as defined in claim 1, wherein:

a) a first plate is attached to said first component for attaching said first component to a chair.

7. A device for joining chairs in a row as defined in claim 1, wherein:

a ) a second plate is attached to said second component for attaching said second component to a chair.

8. A system for joining chairs in a row, comprising:

a) a chair;

b) a first component mounted to a chair;

c) a first borehole defined in said first component;

d) a first locking pin disposed in said first component and extending into said first borehole;

e) a second component mounted to said chair and said second component being spaced from said first component;

f) a second borehole defined in said second component;

g) a second locking pin disposed in said second component and extending into said second borehole;

h) a connection element displaceably mounted in said first borehole, said connection element being configured for insertion into the second borehole of a second component mounted on a second chair, and a first locking element provided on said connection element for engaging said first locking pin for preventing displacement of said connection element relative to said first component;

i) a second locking element provided on said connection element for engaging said second locking pin for preventing displacement of said connection element; and j) a pair of extensions having free ends defining an outwardly open slot in said connection element, and said outwardly open slot being configured for receiving said second locking pin.

9. A system for joining chairs in a row as defined in claim 8, wherein:

a) a spring is provided in said first component for biasing said first locking pin into engagement with said connection element.

10. A system for joining chairs in a row as defined in claim 8, wherein:

a) a spring is provided in said second component for biasing said second locking pin into engagement with said connection element.

11. A system for joining chairs in a row as defined in claim 8, wherein:

a) said first locking element includes a recess defined in a slot wall of one of said extensions defining said outwardly open slot.

12. A system for joining chairs in a row as defined in claim 11, wherein:

a) a snap-in element is provided on said first locking pin;

b) a bevel is provided at the free end of one of said extensions defining said outwardly open slot, said bevel is configured for engaging said snap-in element for moving said first locking pin.

13. A system for joining chairs in a row as defined in claim 8, wherein:

a) a first plate is disposed between and attaches said first component to a chair.

14. A system for joining chairs in a row as defined in claim 8, wherein:

a) a second plate is disposed between and attaches said second component to a chair.

* * * * *